US006203278B1

(12) United States Patent
Mumpower

(10) Patent No.: US 6,203,278 B1
(45) Date of Patent: Mar. 20, 2001

(54) BLOWER WHEEL WITH CENTER DISC HAVING ROUGHENED BLADE ENGAGING SURFACE

(75) Inventor: Ritch L. Mumpower, Dayton, OH (US)

(73) Assignee: Lau Industries, Inc., Dayton, OH (US)

( * ) Notice: Subject to any disclaimer, the term of this patent is extended or adjusted under 35 U.S.C. 154(b) by 0 days.

(21) Appl. No.: 09/339,756

(22) Filed: Jun. 24, 1999

Related U.S. Application Data

(60) Provisional application No. 60/120,537, filed on Feb. 17, 1999.

(51) Int. Cl.[7] ..... F04D 29/38

(52) U.S. Cl. ..... 416/178; 416/195; 416/241 R

(58) Field of Search ..... 416/178, 184, 416/187, 188, 195, 214 R

(56) References Cited

U.S. PATENT DOCUMENTS

| | | | | |
|---|---|---|---|---|
| D. 299,211 | | 1/1989 | Ahlgren . | |
| 1,366,605 | | 1/1921 | Steenstrup . | |
| 2,231,062 | * | 2/1941 | Evans | 416/195 |
| 2,537,805 | | 1/1951 | Wilken . | |
| 2,628,419 | * | 2/1953 | Wilken | 416/178 |
| 2,651,830 | | 9/1953 | Wilken et al. . | |
| 2,932,446 | * | 4/1960 | Zaro | 416/178 |
| 3,164,319 | * | 1/1965 | Mayne | 416/178 |
| 3,423,012 | | 1/1969 | Baker . | |
| 3,578,878 | | 5/1971 | Ross . | |
| 3,608,174 | | 9/1971 | Baker . | |
| 4,025,231 | | 5/1977 | Kochevar et al. . | |
| 4,120,084 | | 10/1978 | Wallman . | |
| 4,515,527 | | 5/1985 | Baker . | |
| 4,738,593 | | 4/1988 | Reifschneider . | |
| 5,013,215 | * | 5/1991 | Diehl | 416/178 |
| 5,551,836 | | 9/1996 | Roth et al. . | |
| 5,730,651 | | 3/1998 | Chen et al. . | |

* cited by examiner

*Primary Examiner*—Edward K. Look
*Assistant Examiner*—Ninh Nguyen
(74) *Attorney, Agent, or Firm*—Biebel & French

(57) ABSTRACT

A centrifugal blower wheel including a center disc assembly and a blade assembly. The blade assembly includes a plurality of blades, each blade including a notch which is engaged over a peripheral edge of the disc assembly in frictional engagement. The peripheral edge of the center disc assembly includes axially outwardly facing surfaces for engaging edges of the notches in the blades, and the axially facing surfaces are formed as roughened surfaces, including a plurality of grooves and/or ridges, for facilitating engagement between the notches of the blades and the center disc assembly to thereby positively prevent relative movement between the center disc assembly and the blade assembly when a torque is applied to the center disc assembly to rotate the centrifugal blower wheel.

12 Claims, 3 Drawing Sheets

BLOWER WHEEL WITH CENTER DISC HAVING ROUGHENED BLADE ENGAGING SURFACE

CROSS REFERENCE TO RELATED APPLICATION

Applicant claims the benefit of the filing date of Provisional Application Serial No. 60/120,537 filed Feb. 17, 1999.

BACKGROUND OF THE INVENTION

1. Field of the Invention

This application relates to centrifugal blower wheels such as used in air moving equipment, including furnaces, air conditioners, and HVAC equipment in general. In particular, the present application is directed to disc type centrifugal blower wheels having a center disc and a plurality of blades, each blade having a notch frictionally engaged over the edge of the center disc.

2. Related Prior Art

Conventional type blower wheels are typically constructed with a pair of disc shaped support plates formed with a conical shape and located in abutting relation with each other such that the outer edges of the plates are joined together and the central areas of the plates are in spaced relation to each other. Each plate includes a hub joined thereto whereby the plates are mounted to a common drive shaft. The plates and hubs define a center disc assembly which is driven in rotation by the common shaft. A blade assembly comprising a plurality of circumferentially spaced blades are arranged around and supported on the outer peripheral edge of the disc assembly. In a known construction, each of the blades is provided with a notch located centrally between either end of the blade and located at an inner edge of the blade. A peripheral edge of each of the plates is positioned in frictional engagement with an adjacent notch edge, and the frictional engagement between the center disc assembly and the blade notches define a connection between the blade assembly and the center disc assembly such that rotation of the center disc assembly causes rotation of the blade assembly. Examples of such blower wheel constructions are shown in U.S. Pat. Nos. 3,423,012 and 4,515,527.

While this construction has been used for a number of years with satisfactory results, there is an ongoing need for an improved connection between the center disc assembly and the blade assembly. In short, there is a need for the formation of a positive connection between the two assemblies for preventing slippage of the blade assembly relative to the disc assembly in response to torque applied to the drive shaft supporting the center disc assembly.

SUMMARY OF THE INVENTION

The present invention is directed to an improvement in centrifugal blower wheels which increases the frictional forces preventing relative movement between a center disc assembly of the blower wheel and a blade assembly of the blower wheel.

The centrifugal blower wheel of the present invention includes a circular center disc having a central shaft mounting structure for supporting the center disc on a driving shaft. A plurality of elongated blades are arranged parallel to and in circumferentially spaced relation to each other around the circumference of the center disc. Each of the blades includes a notch for receiving and frictionally engaging the peripheral edge of the center disc, and the peripheral edge of the center disc includes a distinct roughened surfaced for increasing frictional forces between the center disc and the blades.

In a further aspect of the invention, the roughened surface comprises distinct raised surfaces extending outwardly from an axially facing surface of the center disc, parallel to a direction of elongation of the blades.

The center disc comprises two plates joined together wherein outer peripheral edges of the joined plates are bent away from each other to thereby define a dovetail configuration around the periphery of the disc. Each of the blades is formed with a dovetail shaped cutout area or notch for receiving the dovetail configuration of the outer edge of the disc. In the preferred embodiment of the invention, axially facing surfaces of each of the outer peripheral edges of the discs, facing the edges of the notches in the blades, are formed with a distinct roughened surface for engaging the notch edges and preventing relative slippage between the center disc assembly and the blade assembly.

It is therefore and object of the present invention to provide an improved center disc assembly for a centrifugal blower wheel for providing positive engagement with the blades of a blade assembly to prevent slippage.

It is a further object of the invention to provide the center disc assembly with a roughened peripheral edge surface which facilitates engagement between the peripheral edge of the disc and notches formed in the blades of the blade assembly.

Other objects and advantages of the invention will be apparent from the following description and the accompanying drawings.

DETAILED DESCRIPTION OF THE PREFERRED EMBODIMENT

Figure 1:
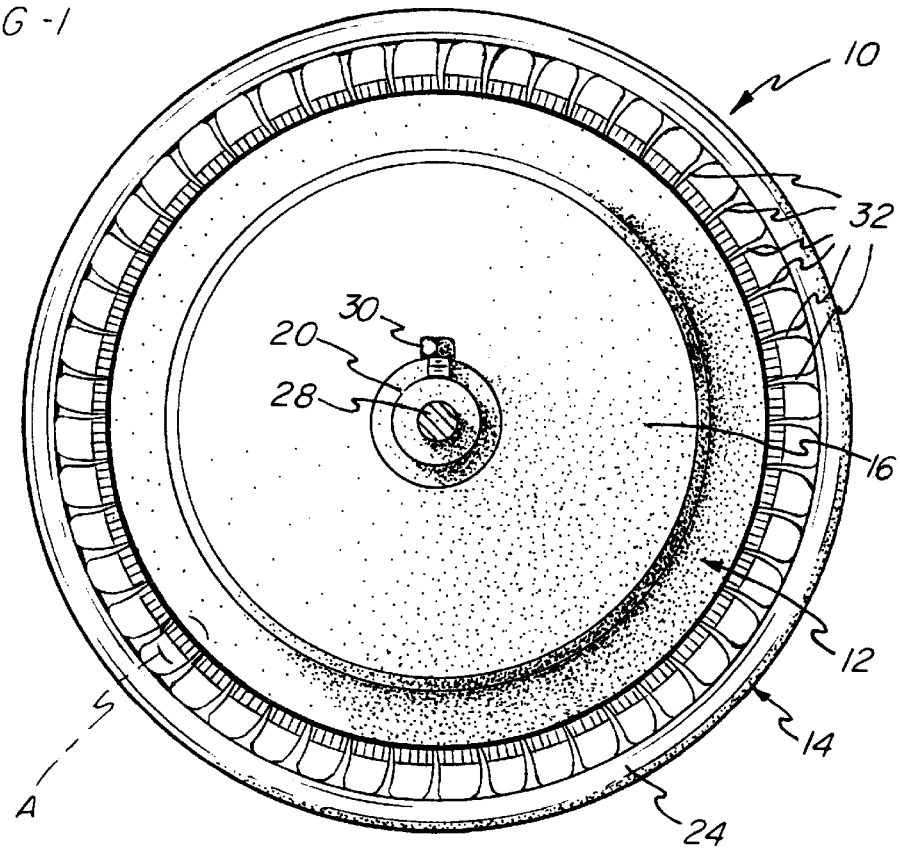
FIG. 1 is an end elevation view of a blower wheel incorporating the present invention.
Figure 3:
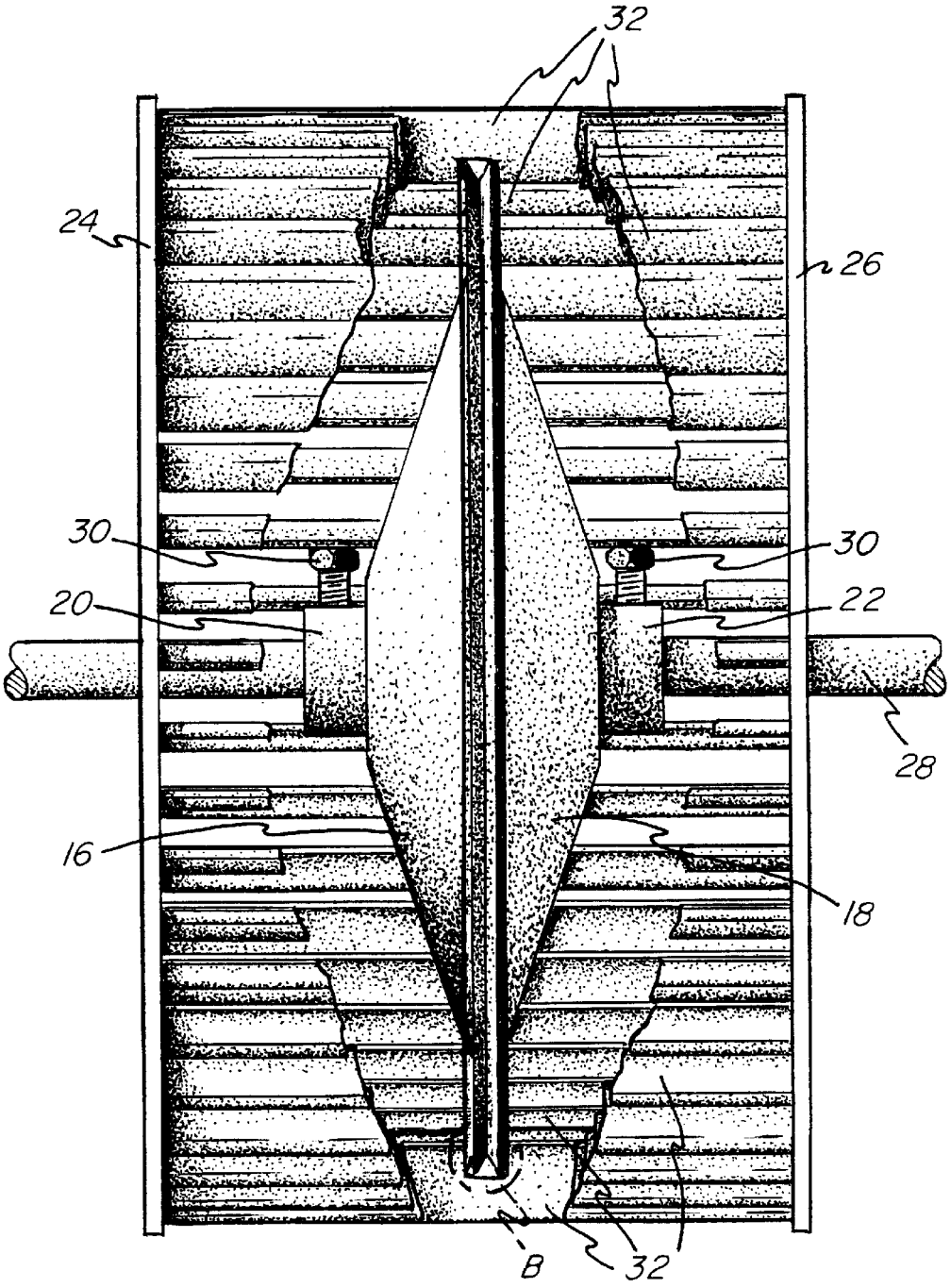
FIG. 3 is a side elevation view of the wheel of FIG. 1, partially cut away to show the center disc.

Referring initially to FIGS. 1 and 3, the centrifugal blower wheel 10 of the present invention generally includes a center disc assembly 12 and a blade assembly 14. The center disc assembly 12 includes a first plate or disc member 16 and a second plate or disc member 18, each of which is formed with a conical shape and which are abutted against and joined to each other adjacent peripheral edges 17, 19 thereof.

Each of the disc members 16 and 18 includes a hub 20 and 22 respectively, wherein the disc members 16, 18 have central portions that are swaged to the hubs 20, 22 for supporting the central disc assembly 12 on a driving shaft 28 between conventional end rings 24 and 26. The blower wheel, for the purposes of this invention, may be assembled essentially as shown in Wilken, U.S. Pat. No. 2,537,805, issued Jan. 9, 1951, and incorporated herein by reference.

The shaft 28 passes through the hubs 20 and 22, and each of the hubs 20 and 22 is preferably provided with a set screw 30 for facilitating positive positioning of the center disc assembly on the shaft 28 for rotation with the shaft 28. However, it should be understood that the present invention is not limited to the particular means of attachment of the centrifugal blower 10 to the shaft 28, and that other attachment structures may be incorporated for attaching the blower wheel 10 to the shaft 28.

Figure 4:
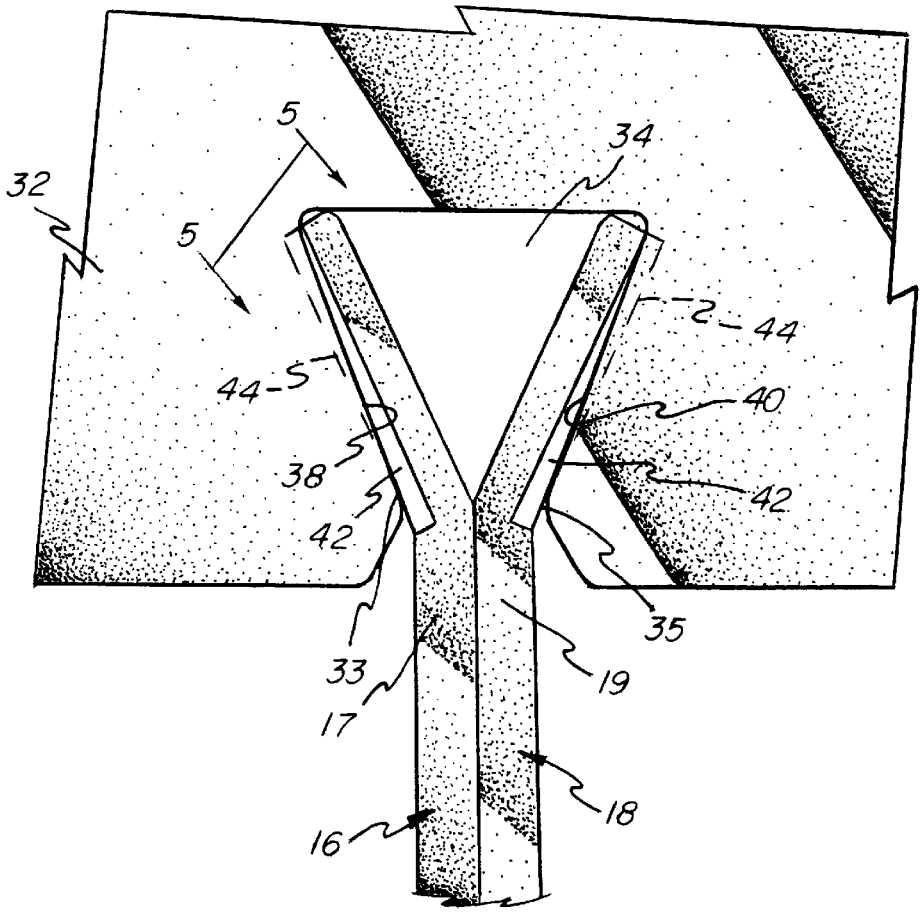
FIG. 4 is an enlarged fragmentary view of the peripheral edge of the wheel in an area defined by the broken outline labeled B in FIG. 3.

Referring to FIG. 4, the outer peripheral edges 17, 19 of the disc members 16, 18 are bent outwardly away from each other to define a generally V-shaped or dovetail cross section for the outer edge of the disc assembly 12. The blade assembly 14 includes a plurality of blades 32 extending parallel to the axis of the driving shaft 28 and having ends attached to the end rings 24, 26. Each of the blades 32 includes a dovetail shaped cutout area or notch 34 for receiving the dovetail shaped peripheral edge of the center disc assembly 12.

Figure 2:
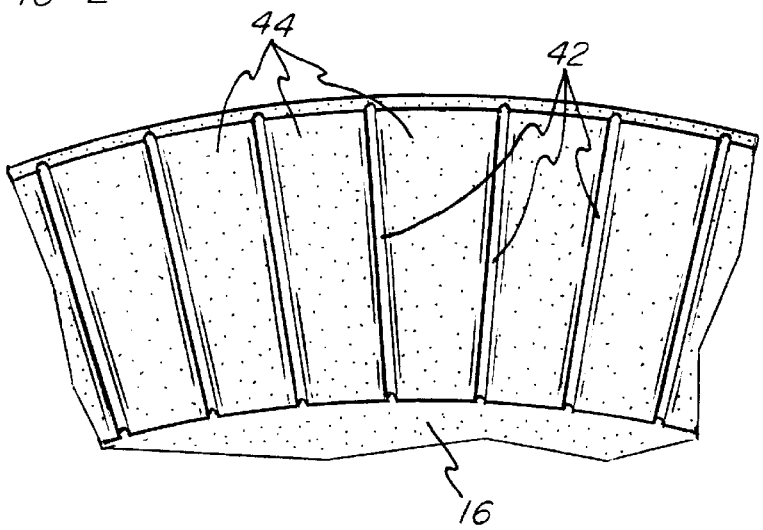
FIG. 2 is an enlarged fragmentary view of the peripheral edge portion of FIG. 1, in an area defined by the broken outline labeled A in FIG. 1, illustrating the radial grooves and ridges defined in the peripheral edge of the center disc.
Figure 5:
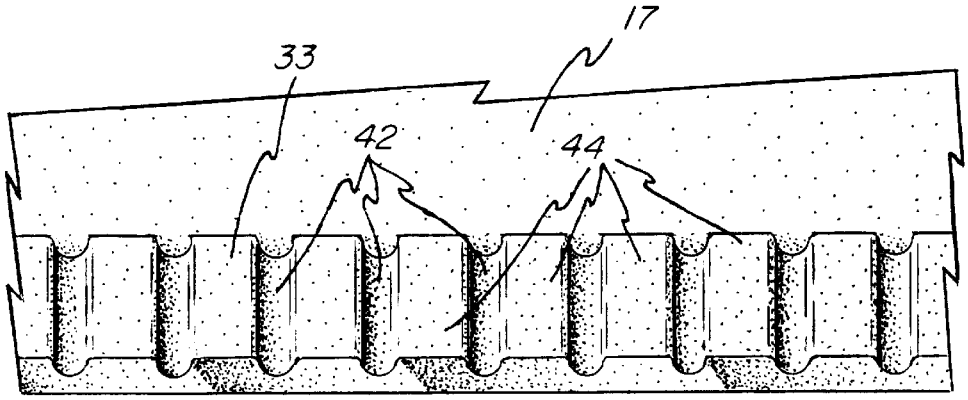
FIG. 5 is a view of the edge of one of the plates forming the center disc taken along line 5—5 in FIG. 4.

Referring further to FIGS. 2 and 5, the peripheral edges 17, 19 of the disc members 16, 18 each include an axially facing surface 33, 35, respectively, wherein the surfaces 33, 35 face toward respective edges 38, 40 of the notches 34.

The notches 34 of the blades 32 are engaged in frictional engagement with the surfaces 33, 35 of the center disc assembly 12 and, in order to facilitate frictional engagement, and prevent relative movement between the center disc assembly 12 and blades 32, the axially facing surfaces 33, 35 are provided with a roughened surface. In the preferred embodiment, the roughened surface comprises serrations which may be defined by forming a plurality of circumferentially spaced radially extending grooves 42 along the axially facing surfaces 33, 35, such that the peripheral edge of the center disc assembly 12 is defined by alternating grooves 42 and ridges 44 wherein the ridges 44 define discrete raised areas extending out in the direction of elongation of the blades 32. Engagement of the notch edges 38, 40 in the grooves 42 and against the ridges 44 provides a positive engagement between the peripheral edges 17, 19 of the plates 16, 18 of the disc assembly 12 and the blades 32 to thereby prevent rotational slippage between the center disc assembly 12 and the blade assembly 14.

It should be understood that other roughened surface characteristics may be provided to provide improved resistance to movement between the blades 32 and the center disc assembly 12, and in particular for facilitating engagement between the inwardly facing edges 38, 42 of the blade notches 34 and the axially facing surfaces 33, 35 of the center disc assembly 12. Further, it should be apparent that the present invention provides an improved engagement surface between the center disc assembly 12 and the blade assembly 14 which facilitates transmission of torque from the driving shaft 28 to the blower wheel 10 without slippage between the center disc assembly 12 and the blades 32.

While the form of apparatus herein described constitutes a preferred embodiment of this invention it is to be understood that the invention is not limited to this precise form of apparatus and that changes may be made therein without departing from the scope of the invention which is defined in the appended claims.

What is claimed is:

1. A centrifugal blower wheel comprising:

a circular center disc having a central shaft mounting structure for supporting said center disc on a driving shaft, said center disc defining an outer peripheral edge;

a plurality of elongated blades arranged parallel to and in spaced relation to each other around the circumference of said center disc;

each said blade including a notch for receiving and frictionally engaging said peripheral edge therein;

said peripheral edge including a distinct roughened surface for increasing frictional forces between said center disc and said blades; and wherein said roughened surface comprises discrete raised surfaces extending outwardly from a surface of said peripheral edge in an axial direction generally parallel to a direction of elongation of said blades.

2. The centrifugal blower wheel as in claim 1 wherein said discrete raised surfaces are defined by a plurality of circumferentially spaced, radially extending grooves and ridges.

3. The centrifugal blower wheel as in claim 1 wherein said surface of said peripheral edge comprises a surface facing in an axial direction of said blower wheel.

4. The centrifugal blower wheel as in claim 1 wherein said center disc comprises two plates, each said plate comprising an outer peripheral edge and each said peripheral edge defining a distinct roughened surface.

5. The centrifugal blower wheel as in claim 4 wherein each of said plates is formed with a conical shape.

6. A centrifugal blower wheel comprising:

a circular center disc having a central shaft mounting structure for supporting said center disc on a driving shaft, said center disc defining an outer peripheral edge;

a plurality of elongated blades arranged parallel to and in spaced relation to each other around the circumference of said center disc;

each said blade including a notch for receiving and frictionally engaging said peripheral edge therein;

said peripheral edge including a distinct roughened surface for increasing frictional forces between said center disc and said blades;

said center disc comprising two plates, each said plate comprising an outer peripheral edge and each said peripheral edge defining a distinct roughened surface; and wherein outermost edges of said plates are bent away from each other whereby said peripheral edge of said center disk is provided with a dovetail shape, and said roughened surfaces are defined on said outermost edges.

7. A centrifugal blower wheel comprising:

a circular center disc including first and second circular plates, each of said plates formed with a conical central area and each said plate including an outer peripheral edge;

a central shaft mounting structure on said center disk for supporting said center disk on a driving shaft;

a plurality of elongated blades arranged parallel to and in spaced relation to each other around the circumference of said center disk;

each said blade including a notch for receiving and frictionally engaging said peripheral edges of said plates therein;

said peripheral edge of at least one of said plates including a distinct roughened surface for increasing frictional forces between said center disk and said blades; and wherein said roughened surface comprises discrete raised surfaces extending outwardly from an axially facing surface of said peripheral edge of said at least one plate, said raised surfaces extending in an axial direction parallel to a direction of elongation of said blades.

8. The centrifugal blower wheel as in claim 7 wherein said discrete raised surfaces are defined by a plurality of circumferentially spaced, radially extending grooves and ridges.

9. A centrifugal blower wheel comprising:

a circular center disc including first and second circular plates each of said plates formed with a conical central area and each said plate including an outer peripheral edge;

a central shaft mounting structure on said center disk for supporting said center disk on a driving shaft;

a plurality of elongated blades arranged parallel to and in spaced relation to each other around the circumference of said center disk;

each said blade including a notch for receiving and frictionally engaging said peripheral edges of said plates therein;

said peripheral edge of at least one of said plates including a distinct roughened surface for increasing frictional forces between said center disk and said blades; and wherein said peripheral edges of said plates are bent away from each other whereby said peripheral edges define a dovetail shape for receiving a dovetail shaped notch of each of said blades.

10. The centrifugal blower wheel as in claim 9 including roughened surfaces on axially facing surfaces of each of said plates for increasing frictional forces between said center disk and said blades.

11. The centrifugal blower wheel as in claim 10 wherein said roughened surfaces comprise discrete raised surfaces extending outwardly from said axially facing surfaces at said peripheral edges of said plates, said raised surfaces extending in an axial direction parallel to a direction of elongation of said blades.

12. The centrifugal blower wheel as in claim 11 wherein said discrete raised surfaces are defined by a plurality of circumferentially spaced, radially extending grooves and ridges.

* * * * *